US007476136B2

(12) United States Patent
Radue et al.

(10) Patent No.: US 7,476,136 B2
(45) Date of Patent: Jan. 13, 2009

(54) EXHAUST VALVE FOR TWO-STROKE ENGINE

(75) Inventors: Martin Radue, Kenosha, WI (US); Sebastian Strauss, Virginia Beach, VA (US); Peter Lucier, Chicago, IL (US); David Silorey, Racine, WI (US)

(73) Assignee: BRP US Inc., Sturtevant, WI (US)

( * ) Notice: Subject to any disclaimer, the term of this patent is extended or adjusted under 35 U.S.C. 154(b) by 277 days.

(21) Appl. No.: 11/355,191

(22) Filed: Feb. 16, 2006

(65) Prior Publication Data

US 2007/0028597 A1 Feb. 8, 2007

Related U.S. Application Data

(60) Provisional application No. 60/653,607, filed on Feb. 16, 2005.

(51) Int. Cl.
*B63H 21/00* (2006.01)
*F01N 3/00* (2006.01)
*F01N 3/02* (2006.01)

(52) U.S. Cl. ..... 440/89 R; 60/282; 60/317

(58) Field of Classification Search ..... 440/89 R, 440/89 A, 89 B, 89 C, 89 D, 89 E, 89 G, 440/89 J; 60/282, 317, 312–314, 324
See application file for complete search history.

(56) References Cited

U.S. PATENT DOCUMENTS

| | | | | |
|---|---|---|---|---|
| 2,460,419 | A | 2/1949 | Kincannon | |
| 3,371,645 | A | 3/1968 | Ward | |
| 3,576,172 | A | 4/1971 | Ward | |
| 3,603,091 | A | 9/1971 | Stahmer | |
| 4,121,552 | A | 10/1978 | Mithuo et al. | |
| 4,218,994 | A | 8/1980 | Reed | |
| 4,325,335 | A | 4/1982 | Shibata | |
| 4,341,188 | A | 7/1982 | Nestrom | |
| 4,342,195 | A * | 8/1982 | Lo | 60/313 |
| 4,364,346 | A | 12/1982 | Shiohara | |
| 4,368,703 | A | 1/1983 | Shibata | |
| 4,388,894 | A | 6/1983 | Tanaka et al. | |
| 4,391,234 | A | 7/1983 | Holsleitner | |
| 4,399,788 | A | 8/1983 | Bostelmann | |
| 4,516,540 | A | 5/1985 | Nerstrom | |
| 4,660,378 | A | 4/1987 | Sharpf | |
| 4,660,514 | A | 4/1987 | Nerstrom | |
| 4,732,117 | A | 3/1988 | Tanahashi et al. | |
| 4,732,118 | A | 3/1988 | Tanahashi et al. | |
| 4,766,854 | A | 8/1988 | Sekimoto | |
| 4,914,911 | A | 4/1990 | Bertram | |
| 4,969,329 | A | 11/1990 | Bolton et al. | |

(Continued)

FOREIGN PATENT DOCUMENTS

| | | |
|---|---|---|
| JP | 55-112823 | 9/1980 |

*Primary Examiner*—Lars A Olson
*Assistant Examiner*—Daniel V Venne
(74) *Attorney, Agent, or Firm*—Olser, Hoskins & Harcourt LLP

(57) ABSTRACT

A two-stroke internal combustion engine has two cylinders each having an exhaust port. Two exhaust conduits are connected to the two exhaust ports. A passage is provided between the two conduits to fluidly communicate the two together. An actuator moves a valve to open or close the passage depending on the engine speed.

36 Claims, 11 Drawing Sheets

U.S. PATENT DOCUMENTS

| | | | | |
|---|---|---|---|---|
| 4,986,780 | A | 1/1991 | Sougawa | |
| 4,995,233 | A | 2/1991 | Lullof | |
| 5,020,487 | A | 6/1991 | Krüger | |
| 5,134,851 | A | 8/1992 | Davis | |
| 5,161,372 | A | 11/1992 | Whipple | |
| 5,311,854 | A | 5/1994 | Cullum | |
| 5,331,927 | A | 7/1994 | Solomon et al. | |
| RE34,764 | E | 10/1994 | Blair | |
| 5,537,958 | A | 7/1996 | Nishimura et al. | |
| 5,662,073 | A | 9/1997 | Tanaka | |
| 5,709,177 | A | 1/1998 | Worth et al. | |
| 5,832,881 | A | 11/1998 | Karay et al. | |
| 5,954,554 | A | 9/1999 | Bates | |
| 6,039,012 | A | 3/2000 | Motoyama | |
| 6,135,834 | A | 10/2000 | Polakowski | |
| 6,220,907 | B1 | 4/2001 | Shimizu | |
| RE37,230 | E | 6/2001 | Schlunke et al. | |
| 6,250,982 | B1 | 6/2001 | Kashima | |
| 6,352,056 | B1 | 3/2002 | Ruman | |
| RE37,631 | E | 4/2002 | Nanami et al. | |
| RE82,214 | | 4/2002 | Nanami et al. | |
| 6,394,049 | B2 | 5/2002 | Ishida et al. | |
| 6,481,394 | B1 | 11/2002 | Hiki | |
| 6,511,356 | B2 | 1/2003 | Yukishima | |
| 6,632,110 | B2 | 10/2003 | Kato | |
| 6,782,850 | B2 | 8/2004 | Tapia | |
| 6,886,507 | B2 | 5/2005 | Olson | |
| 6,895,908 | B2 | 5/2005 | Isoda et al. | |
| 7,000,594 | B2 | 2/2006 | Arakawa et al. | |
| 7,004,805 | B2 | 2/2006 | Lee et al. | |
| 7,090,048 | B2 * | 8/2006 | Albertson et al. | 181/240 |
| 2002/0068490 | A1 | 6/2002 | Ochai | |
| 2004/0031453 | A1 | 2/2004 | Forbush | |
| 2004/0187813 | A1 | 9/2004 | Meyer | |

* cited by examiner

EXHAUST VALVE FOR TWO-STROKE ENGINE

This application claims priority from U.S. provisional application 60/653,607 filed on Feb. 16, 2005, the entirety of which is incorporated herein by reference.

FIELD OF THE INVENTION

The present invention relates to a two-stroke engine having an exhaust system with a valve. The present invention more specifically relates to an outboard engine having an exhaust system with a valve.

BACKGROUND OF THE INVENTION

In a two-stroke engine, the reciprocating movement of the piston opens and closes the exhaust and transfer ports. After combustion has occurred, the piston moves downwardly, uncovering the exhaust port, and allowing exhaust gases to exit the cylinder. When this happens a pressure wave, commonly called a blowdown pulse, is created on the exhaust side of the cylinder. This pulse as it travels down an exhaust pipe with expanding section creates reflections having a negative magnitude back towards the cylinder. This creates a pressure wave which helps to suck the exhaust gases out of the combustion chamber and a fresh charge of air into the combustion chamber or, as is the case in carburated engines, a fresh mixture of air and fuel. Once all of the exhaust gases have been sucked out of the combustion chamber, some of the fresh charge may get sucked out as well. This is known as the suction pulse.

It was discovered that by attaching a pipe to the exhaust port, the pressure wave would bounce from the end of the pipe and return to the exhaust port. The returning pressure wave pushes the fresh charge back into the combustion chamber before the exhaust port closes, filling it to greater pressures than could normally be achieved. This is known as the plugging pulse.

However, since the pressure waves are generated at the same frequency as the engine is turning, a pipe of a given length will only work over a narrow engine speed range. At engine speeds below that range, the pressure wave returns too soon and bounces back out of the exhaust port. At engine speeds above that range, the pressure wave returns too late because the exhaust port is already closed.

As a general rule, shorter pipes are effective at higher engine speeds, and longer pipes are effective at lower engine speeds.

It was later discovered that by adding a diverging section at the beginning of the pipe and a converging section at the end of the pipe, that the return pulse, although not as strong, is longer, and is therefore more likely to return while the exhaust port is opened. Such pipes are known as tuned pipes and are effective over a broader speed range.

The shape and length of the tuned pipe is based on various factors including the engine type, exhaust temperature, and desired engine operating range. The tuned pipe is "tuned" to be most efficient during that desired engine speed operating range as it cannot be efficient in all ranges.

In multi-cylinder engines having multiple tuned pipes, conduits are sometimes provided to communicate the tuned pipes together. By doing this, the blowdown pulse of one pipe can be used to "plug" the exhaust port associated with another cylinder. By overlapping the blowdown pulses this way, the engine speed range over which the tuned pipes are effective is broadened. This is known as intra-cylinder plugging.

However, intra-cylinder plugging becomes less effective as the number of cylinder is reduced, as there is less of an overlap between the opening of the exhaust ports.

Thus, while current exhaust systems having tuned pipes are effective over a certain engine speed range, there exists a need to provide an engine exhaust system which is effective over a broader range of engine speeds.

SUMMARY OF THE INVENTION

It is an object of the present invention to provide an exhaust system which is effective over a broad range on engine speeds.

It is a further object of the present invention to provide an exhaust system which is effective over at least two engine speed ranges.

In one aspect, the invention provides a two-stroke internal combustion engine having at least two cylinders. Each cylinder has a piston reciprocating therein and an exhaust port associated therewith for exhausting combustion gases therefrom. The exhaust port of each cylinder is opened and closed by reciprocating motion of that cylinder's piston. The engine has exhaust conduits, one conduit associated with each of the cylinders. Each conduit has an inlet, an outlet and an end. The outlet is disposed between the inlet and the end. The inlet of each conduit is in fluid communication with the exhaust port of the cylinder with which that conduit is associated. A passage fluidly communicates two of the exhaust conduits together. A valve has a first position closing the passage and allowing pressure waves from each of the cylinders communicating via the passage to travel from the inlet of the conduit associated with that cylinder, through that conduit to at least a point in that conduit further from the inlet than the passage, and the valve has a second position opening the passage allowing pressure waves from that cylinder to travel from the inlet of that conduit through the passage and into the conduit associated with the other cylinder.

In another aspect, the exhaust conduits have a common wall, and the passage is an aperture in the common wall.

In a further aspect, the engine is also provided with an actuator to move the valve between the first and the second position. A sensor sends a signal indicative of actual engine speed to an electronic control unit which controls the actuator based on a comparison between the actual engine speed and a predetermined engine speed.

In another aspect, the actuator moves the valve to the first position when the actual engine speed is higher than the predetermined engine speed.

In a further aspect, the actuator moves the valve to the first position when the actual engine speed is lower than the predetermined engine speed.

In an additional aspect, a second passage is provided to fluidly communicate the two exhaust conduits together. The second passage is disposed between the first passage and the end of each exhaust conduit.

In yet another aspect, the invention provides an outboard engine having a cowling, and a two-stroke engine enclosed by the cowling. The engine has at least two cylinders. Each cylinder has a piston reciprocating therein and an exhaust port associated therewith for exhausting combustion gases therefrom. The exhaust port of each cylinder is opened and closed by reciprocating motion of that cylinder's piston. The outboard engine also has a vertically oriented driveshaft coupled to the engine, a transmission coupled to the driveshaft, a horizontally oriented propeller shaft coupled to the transmission, and a propeller coupled to the propeller shaft. The engine has exhaust conduits, one conduit associated with each of the cylinders. Each conduit has an inlet, an outlet and an end. The outlet is disposed between the inlet and the end. The inlet of each conduit is in fluid communication with the exhaust port of the cylinder with which that conduit is associated. A passage fluidly communicates two of the exhaust conduits together. A valve has a first position closing the passage and allowing pressure waves from each of the cylinders communicating via the passage to travel from the inlet of the conduit associated with that cylinder, through that conduit to at least a point in that conduit further from the inlet than the passage, and the valve has a second position opening the passage allowing pressure waves from that cylinder to travel from the inlet of that conduit through the passage and into the conduit associated with the other cylinder.

In a further aspect, the invention provides a method of operating an internal combustion engine. One step consists in providing two exhaust conduits each communicating with a different exhaust of the engine and a valve for opening and closing a passage located between the two exhaust conduits so as to fluidly communicate the exhaust conduits together. Another step consists in sensing an actual engine speed. A further step consists in opening the valve when the engine speed is within a first range of speeds and closing the valve when engine is within a second range of speeds.

BRIEF DESCRIPTION OF THE DRAWINGS

Having thus generally described the nature of the present invention, reference will now be made to the accompanying drawings by way of illustration showing a preferred embodiment, in which.

DETAILED DESCRIPTION OF THE INVENTION

The invention is described with reference to an outboard engine. However, it should be understood that the features of this invention can be used with any type of two-stroke internal combustion engine.

Figure 1:
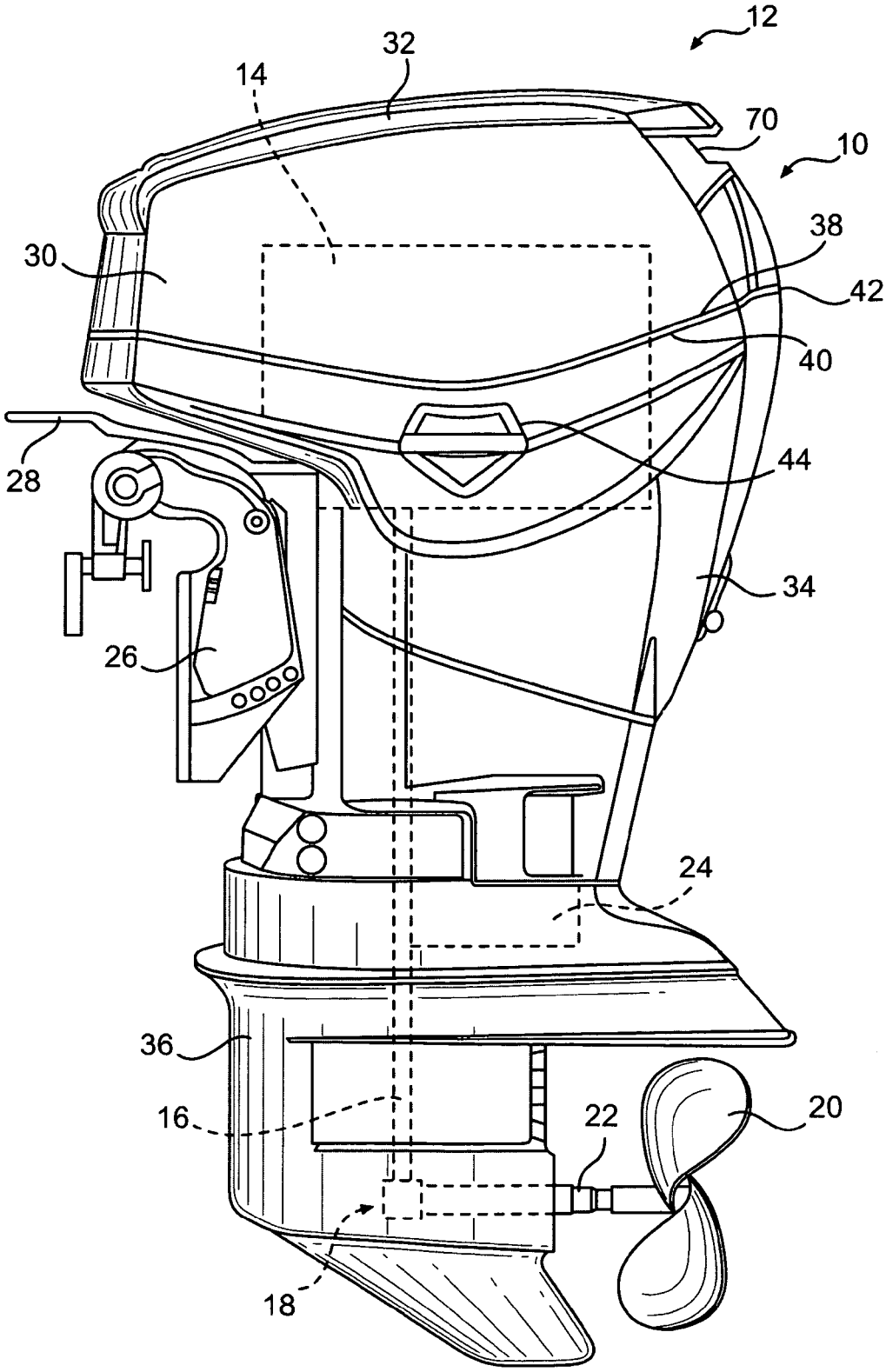
FIG. 1 is a side elevation view of an outboard engine equipped with the present invention.

Referring to the figures, FIG. 1 is a side view of an outboard engine 12 having a cowling assembly 10. The cowling assembly 10 surrounds and protects an engine 14, shown schematically. Engine 14 is a conventional two-stroke internal combustion engine, such as an in-line two-cylinder or a V-4 engine. An exhaust system 24 in accordance with the invention is connected to the engine 14 and is also surrounded by the cowling assembly 10.

The engine 14 is coupled to a vertically oriented driveshaft 16. The driveshaft 16 is coupled to a drive mechanism 18, which typically includes a transmission and a propelling device, such as a propeller 20 mounted on a propeller shaft 22. The drive mechanism 18 could also be a jet propulsion device, turbine or other know propelling mechanism. Other known components of an engine assembly would be included within the cowling. As these components would be readily recognized by one of ordinary skill in the art, further explanation is not necessary.

A mounting support 26 is connected through the cowling assembly 10 to components within the cowling assembly 10 for mounting the outboard engine to a watercraft or other support. The mounting support 26 can take various forms, the details of which are conventionally known. The outboard engine assembly does not require the mounting support 26 to operate.

A steering mechanism 28, such as a tiller, or other control systems, such as trim control, may be provided to allow the driving mechanism to be turned to facilitate directional control of the watercraft or adjusted to affect the orientation of the engine.

The cowling assembly 10 includes several primary components, including an upper motor cover 30 with a top cap 32, and a lower motor cover 34. A lowermost portion, commonly called the gear case 36, is attached to the exhaust housing (not shown in FIG. 1) which is surrounded by the lower motor cover 34. The upper motor cover 30 preferably encloses the top portion of the engine 14. The lower motor cover 34 surrounds the remainder of the engine 14 and can include the exhaust system 24. The gear case 36 encloses the transmission and supports the drive mechanism 18, in a known manner. The propeller shaft 22 extends from the gear case 36 and supports the propeller 20.

The upper motor cover 32 and the lower motor cover 34 are made of sheet material, preferably plastic, but could also be metal, composite or the like. The lower motor cover 34 or other components of the cowling assembly 10 can be formed as a single piece or as several pieces. For example, the lower motor cover 34 can be formed as two lateral pieces that mate along a vertical joint. The lower motor cover 34, which is also made of sheet material, is preferably made of composite, but can also be plastic or metal. One suitable composite is fiberglass.

The upper motor cover 30 has a lower edge 38 that has a contoured vertical profile, preferably with a curved side wall. The lower edge 38 when viewed from the side is generally convex. The lower motor cover 34 has an upper edge 40 that has a contoured vertical profile in a complementary shape to the lower edge 38 of the upper motor cover 30. That is, the upper edge 40 when viewed from the side is curved and generally concave. The lower edge 38 and the upper edge 40 mate together in a sealing relationship when the upper motor cover 30 is attached to the lower motor cover 34. Preferably, a seal 42 is disposed between the upper motor cover 30 and the lower motor cover 34 to form a watertight connection.

A locking mechanism 44 is provided on at least one of the sides of the cowling assembly 10. Preferably, a locking mechanism 44 is provided on each side of the cowling assembly 10.

The upper motor cover 30 is formed with two parts, but could also be a single cover. As seen in FIG. 1, the upper motor cover 30 includes an air intake portion 70 formed as a recessed portion on the rear of the cowling assembly 10. The air intake portion 70 is configured to prevent water from entering the interior of the cowling assembly 10 and accordingly reaching the engine 14. Such configuration can include a tortuous path. A top cap 32 fits over the upper motor cover 30 in a sealing relationship and preferably defines a portion of the air intake portion 70. Alternatively, the air intake portion 70 can be wholly formed in the upper motor cover 30 or even the lower motor cover 34.

Figure 2A:
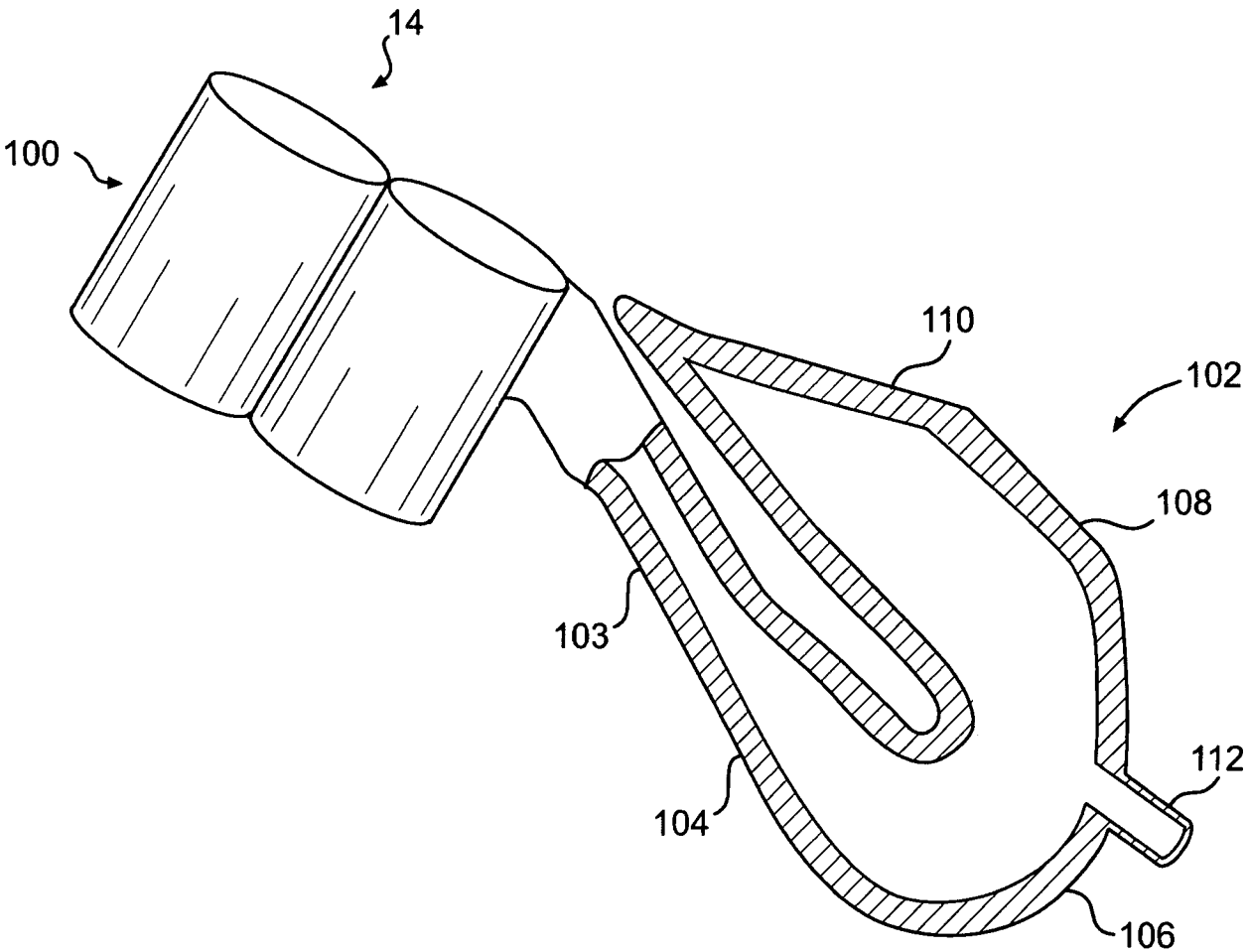
FIG. 2A is a partial cross-sectional view of cylinder and tuned pipe assembly which can be used with the present invention.

Referring now to FIG. 2A, the engine 14 has a pair of cylinders 100. An exhaust conduit 102, which can be used with the present invention, is connected to the exhaust port (not shown) of one of the cylinders 100. Another exhaust conduit (not shown) is connected to the exhaust port of the other of the cylinders 100. FIG. 2A shows a cross-section of exhaust conduit 102 so as to more easily distinguish its geometrical features. The exhaust conduit 102 is a tuned pipe. Starting from the point where exhaust conduit 102 is connected to the exhaust port, the exhaust conduit 102 has an inlet 103 followed by a diverging section 104. The diverging section 104 is then followed by a curved section 106 and a straight section 108. The curved section 106 and the straight section 108 have a generally constant diameter. The end of the exhaust conduit 102 is finally closed by a converging section 110. The outlet 112 of the exhaust conduit 102 is located in the curved section 106.

Figure 2B:
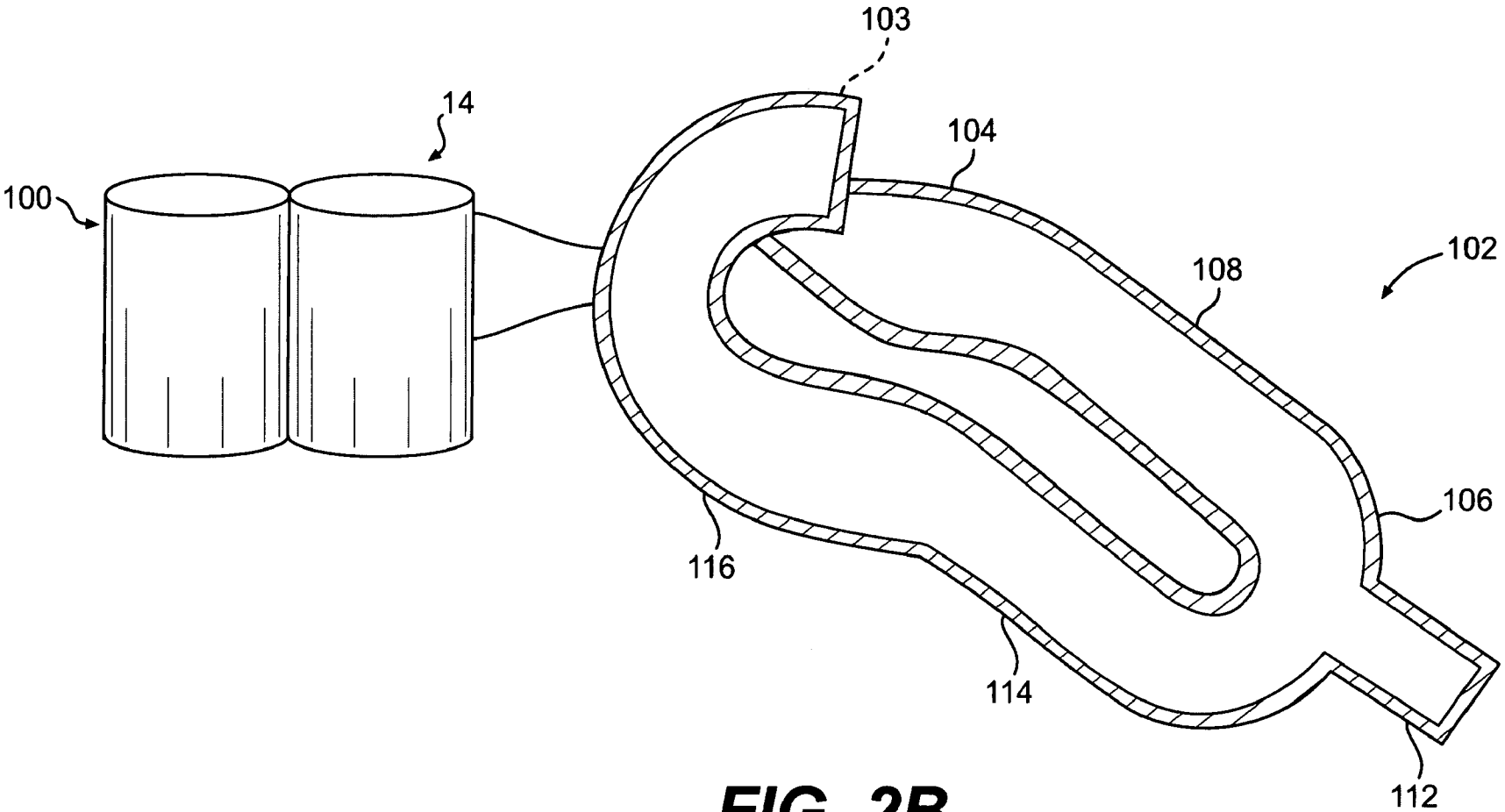
FIG. 2B is a partial cross-sectional view of another cylinder and tuned pipe assembly which can be used with the present invention.

FIG. 2B, shows an engine 14 having an arrangement similar to the one shown in FIG. 2A. The difference is that the exhaust conduit 102 has a different geometry. Starting once again from the point where exhaust conduit 102 is connected to the exhaust port, the exhaust conduit 102 has an inlet 103 (hidden) followed by a diverging section 104. The diverging section 104 is then followed by a straight section 108 followed by a curved section 106, and another straight section 114. The end of the exhaust conduit 102 is finally closed by another curved section 116. The outlet 112 of the exhaust conduit 102 is located in the curved section 106.

FIGS. 2A and 2B illustrate only two possible exhaust conduits 102 that can be used with the present invention. Many other configurations are possible. The dimensions and geometry of the exhaust conduit 102, and the position of the outlet 112 will vary depending on the engine being used, the room available to accommodate the exhaust conduit 102, and the range of engine speeds for which the exhaust conduit is to be effective.

Figure 3:
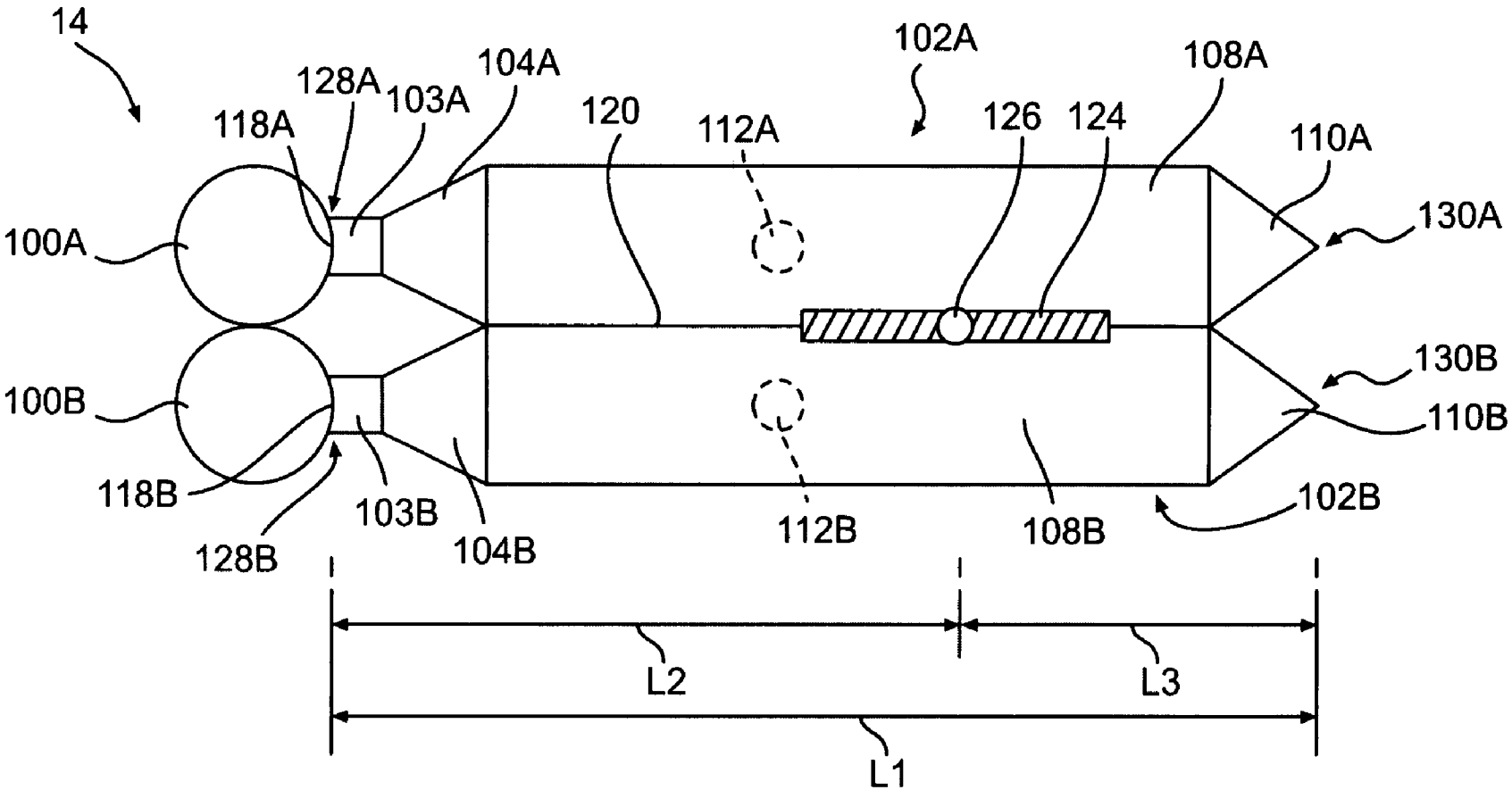
FIG. 3 is a schematic plan view of a first embodiment of the present invention with the valve in the first position.
Figure 4:
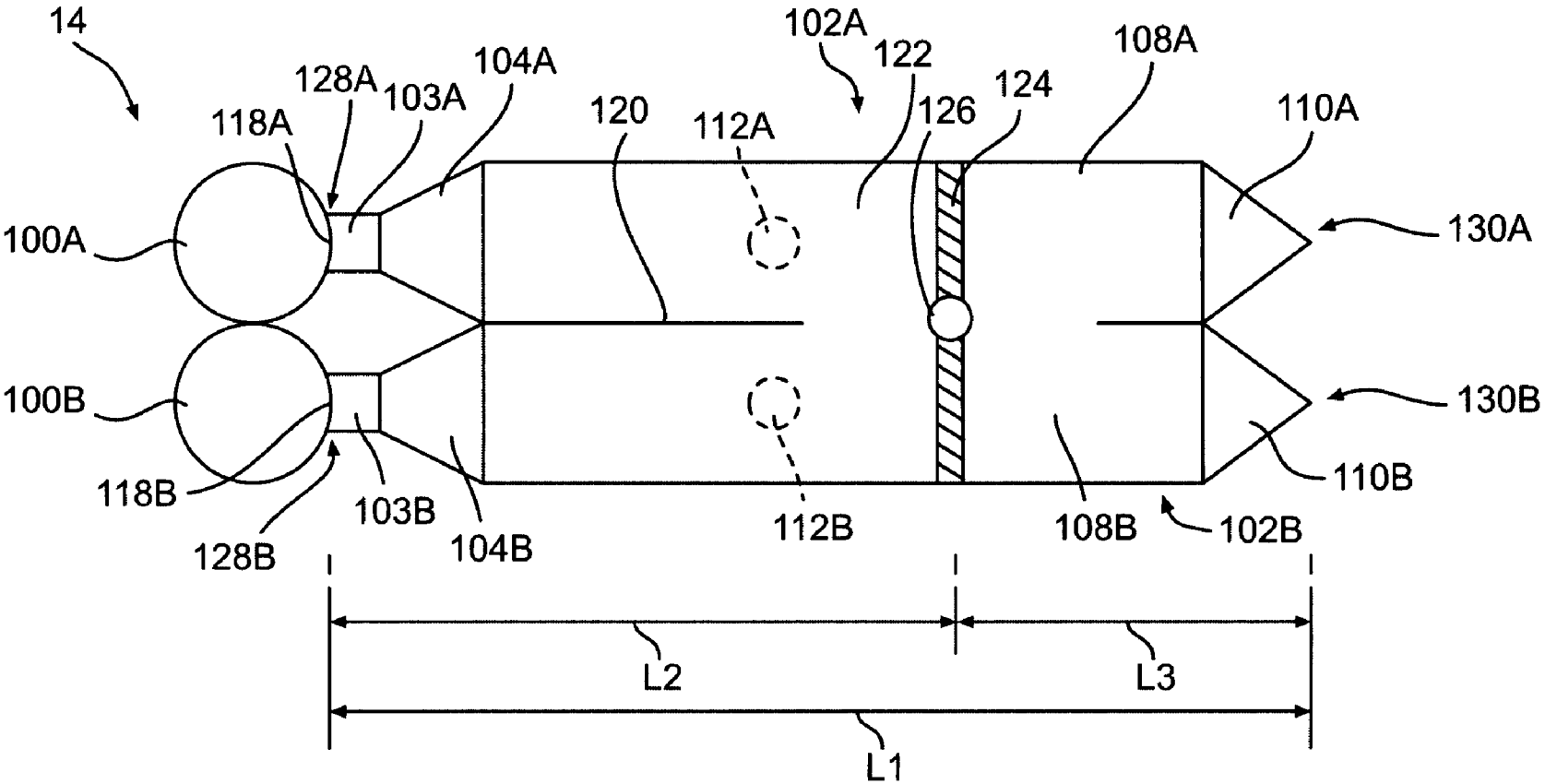
FIG. 4 is a schematic plan view of a first embodiment of the present invention with the valve in the second position.

FIGS. 3 and 4 show a schematic representation of a first embodiment of the present invention. An engine 14 has two cylinders 100A, 100B, each having a corresponding exhaust port 118A, 118B. Each exhaust port 118A, 118 communicates with a corresponding exhaust conduit 102A, 102B. It is also contemplated that the engine could have more than two cylinders, each communicating with its own exhaust conduit, or that each exhaust conduit would communicate with more than one cylinder, as in FIG. 6 for example. The exhaust conduits 102A, 102B are represented as straight conduits with varying diameters for simplicity, but as discussed above, they could have many shapes or sizes. The exhaust conduit 102A can also have a different configuration than that of the exhaust conduit 102B.

The exhaust conduits 102A, 102B, each have an inlet 103A, 103B at a first end 128A, 128B thereof, followed by a diverging section 104A, 104B, a straight section 108A, 108B, and a converging section 110A, 110B at a second end thereof 130A, 130B. The outlets 112A, 112B are located in a side wall of the exhaust conduits.

The exhaust conduits 102A, 102B share a common wall 120. A passage 122 (FIG. 4), in the form of an aperture, is provided in the common wall 122 so as to communicate the exhaust conduits 102A, 102B together. Although FIGS. 3 and 4 show the two exhaust conduits 102A, 102B as having the complete straight sections 108A, 108B having a common wall 120, it is contemplated that the common wall 120 could be a smaller portion of the exhaust conduits 102A, 102B. It is also contemplated that the two exhaust conduits 102A, 102B could have no common wall 120 so as to be completely separate, and have a passage 122 in the form of a conduit to communicate the two together.

A valve 124 is disposed in the passage 122. The valve 124 rotates about pivot 126 between a first position, as shown in FIG. 3, and a second position, as shown in FIG. 4. The pivot point 126 is located a distance L2 from the first ends 128A, 128B, and a distance L3 from the second ends 130A, 130B of the exhaust conduits 102A, 102B. An actuator (not shown), such as an electric motor, rotates the valve about the pivot point 126.

When the valve 124 is in the first position, the passage 122 is closed. This allows the pressure waves from the engine 14 to travel the complete length L1 of the exhaust conduits 102A, 102B before returning to the exhaust ports 128A, 128B. Thus, the pressure waves travels a total distance of 2×L1.

When the valve 124 is in the second position, the passage 122 is opened, but the second ends 130A, 130B of the exhaust conduits 102A, 102 B are blocked, shortening each exhaust conduit 102A, 102B by a length L3. In this case, a pressure wave from the engine 14 coming from the cylinder 100A travels a distance L2 towards the valve 124 in exhaust conduit 102A, then passes through the passage 122, then travels a distance L2 in the second exhaust conduit 102B towards the cylinder 100B, and finally returns to the exhaust port 128A in the reverse direction. Thus, the pressure wave travels a total distance of 4×L2.

Note that the outlets 112A, 112B are locate in the section of the exhaust conduits 102A, 102B between the inlets 128A, 128B and the valve 124, when it is in the second position. This way, the exhaust gases can leave the exhaust conduits through the outlets 112A, 112B to the atmosphere, or a body of water in marine applications, regardless of the position of the valve 124.

As explained earlier, different lengths of exhaust conduits will be effective over different ranges of engine speeds. A shorter exhaust conduit will be effective at higher engine speeds since the pressure wave will take a short period of time to come back to the exhaust port, before the exhaust port closes. A longer exhaust conduit will be effective at lower engine speeds since the pressure wave will take a long period of time to come back to the exhaust port, providing sufficient time for all of the exhaust gases to leave the cylinder, and also not coming back too soon which would cause the pressure wave to travel away from the exhaust port once again, creating another suction of the cylinder before the exhaust port closes, thus losing the advantage originally provided by the returning wave.

In the present invention, the distances traveled by the pressure waves coming from the engine 14 is different when the valve 124 is the first position and when it is in the second position. This allows the exhaust conduits 102A, 102B to be effective over two different ranges of engine speeds, and therefore a broader range of engine speeds.

Referring back to the embodiment shown in FIGS. 3 and 4, an engine speed sensor (not shown) sends a signal indicative of actual engine speed to an electronic control unit (ECU) (not shown). The ECU then compares this value to a predetermined engine speed, for example 5000 RPM. The ECU then sends a signal to the actuator (not shown) to move the valve 124 to the position appropriate for the engine speed.

If for example, the distance 2×L1 is less than the distance 4×L2, then the valve 124 will be moved to the first position (FIG. 3) for engine speeds higher than the predetermined engine speed, and to the second position (FIG. 4) for engine speeds lower than the predetermined engine speed.

However, if the distance 2×L1 is more than the distance 4×L2, then the valve 124 will be moved to the first position (FIG. 3) for engine speeds lower than the predetermined engine speed, and to the second position (FIG. 4) for engine speeds higher than the predetermined engine speed.

The valve 124 is positioned based on which two speed ranges the exhaust conduits 102A, 102B are to be effective.

Figure 5:
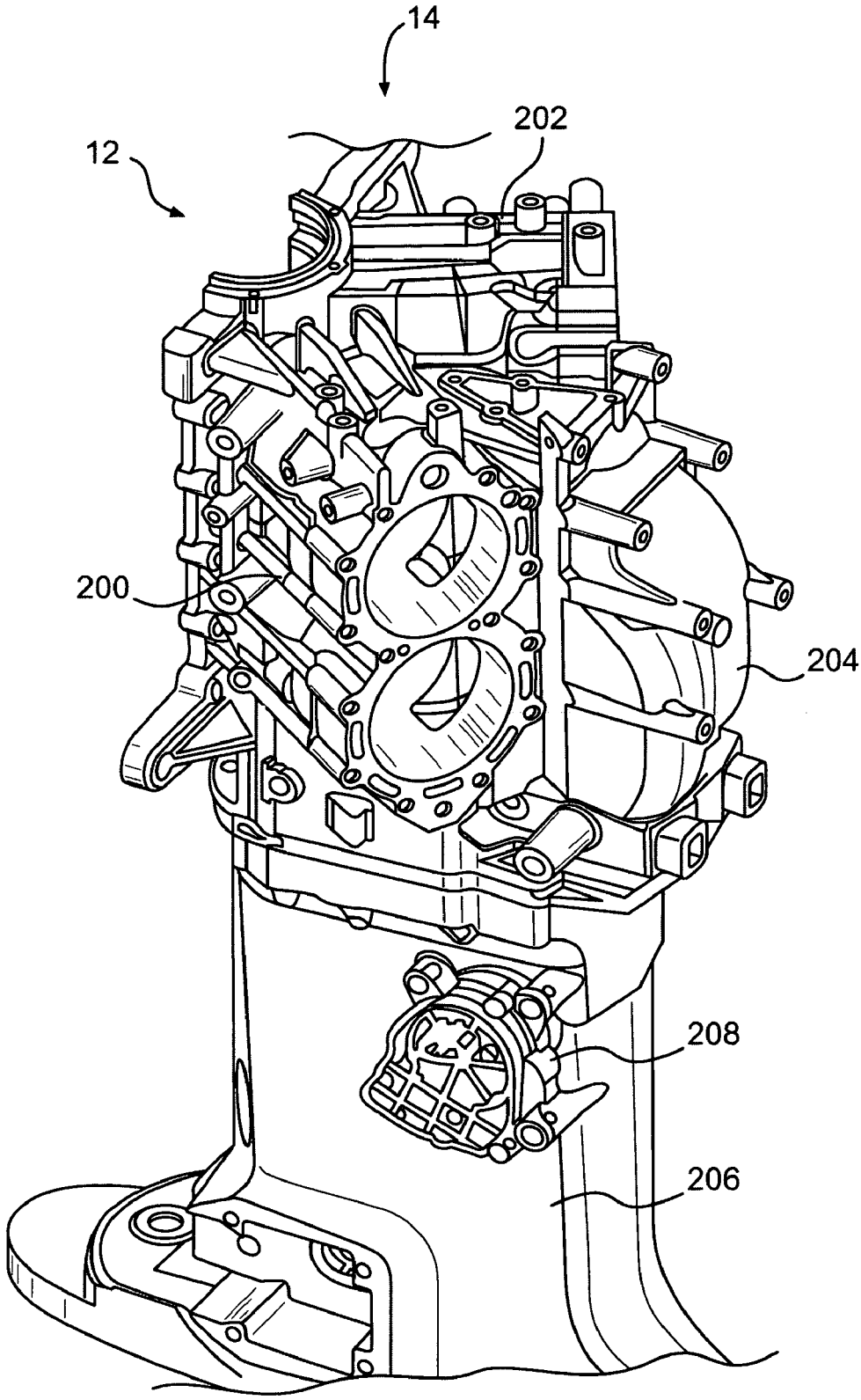
FIG. 5 is a perspective view of an outboard engine with the cowling removed which is equipped with a second embodiment of the present invention.
Figure 6:
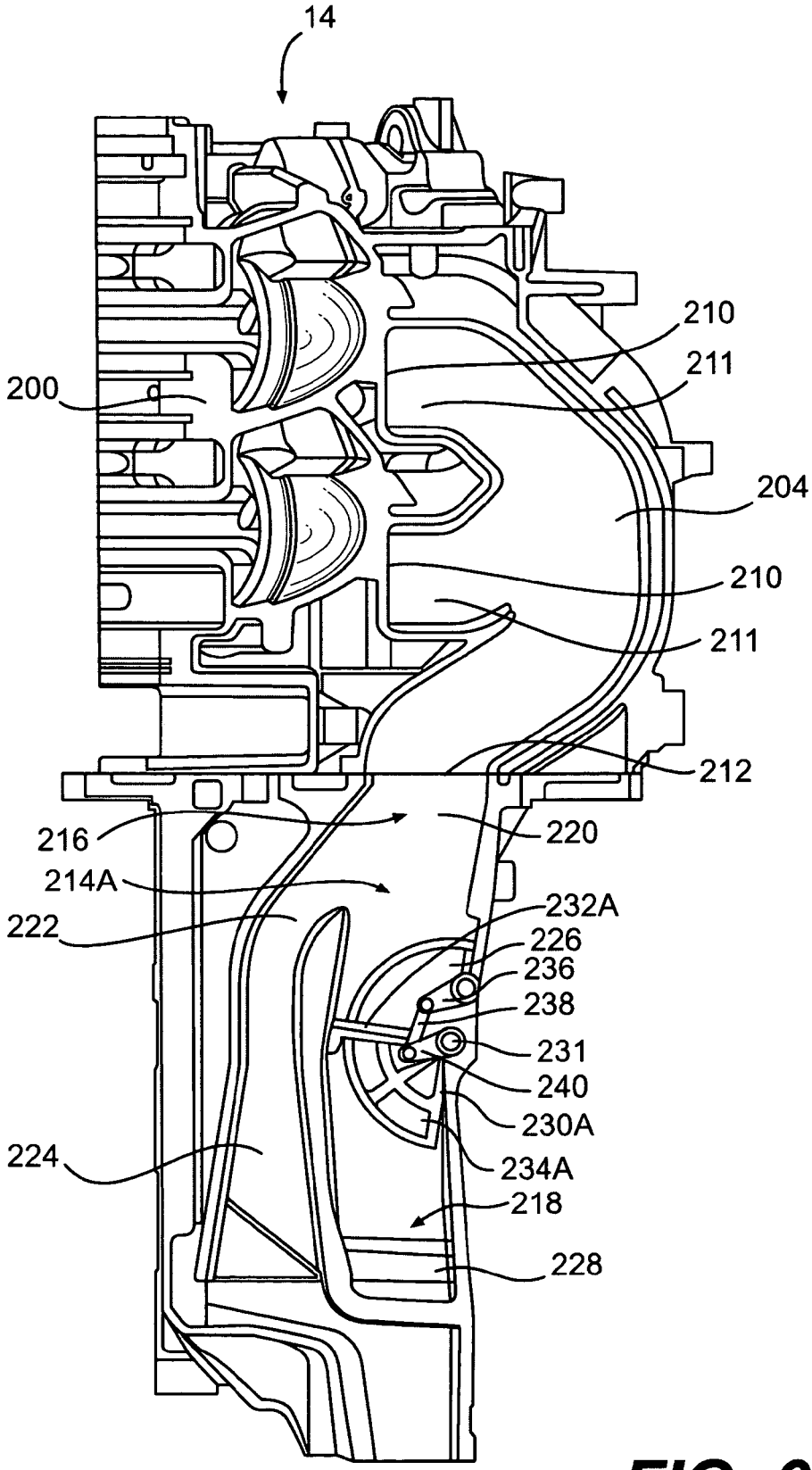
FIG. 6 is a longitudinal cross-section of the outboard engine of FIG. 5 with the valve in the second position.

FIG. 5 shows an outboard engine 12 incorporating a second embodiment of the invention with the cowling assembly removed. The outboard engine 12 has an engine 14 having two cylinder banks 200, 202 of two cylinders each. The two cylinder banks 200, 202 form a V-shape. The engine 14 shown in FIG. 5 is what is know as a V-type engine, and is specifically known as a V-4, because of the four cylinders. An exhaust manifold 204 communicates with the exhaust ports 210 (FIG. 6) of each cylinder. The exhaust manifold 204 has two portions, one for each cylinder bank 200, 202. Each portion has two manifold inlets 211 communicating with two exhaust ports 210 and one manifold outlet 212 (FIG. 6). The manifold outlet 212 of each portion of the exhaust manifold 204 is connected to a corresponding exhaust conduit 214A or 214B. The two exhaust conduits 214A, 214B (FIG. 7) are located in an exhaust housing 206 on which the engine 14 sits. An actuator 208, preferably an electric motor, is located on the side of the exhaust housing 206 and is used to move the valve 230 (FIG. 6).

Figure 8:
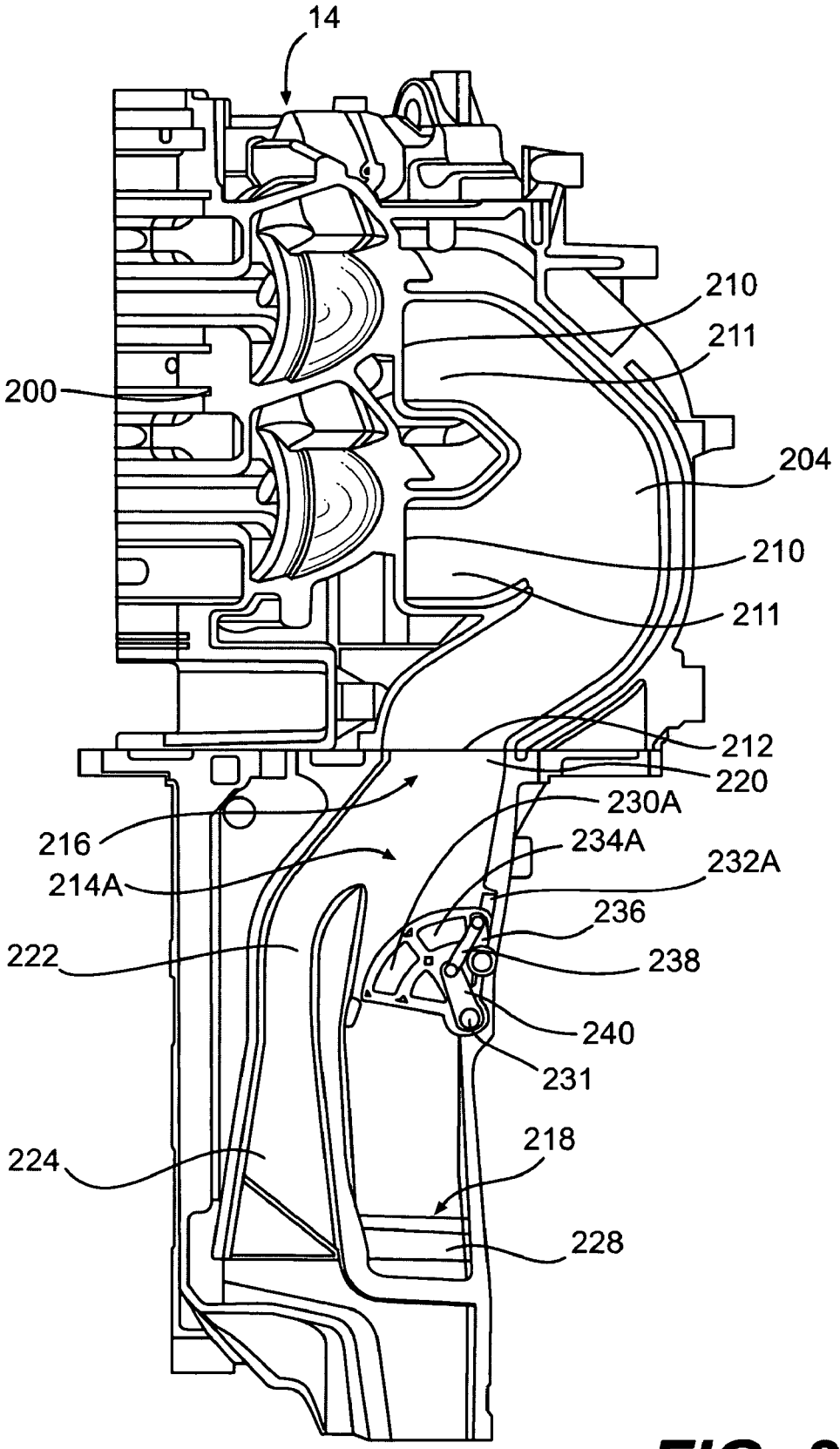
FIG. 8 is a longitudinal cross-section of the outboard engine of FIG. 5 with the valve in the first position.

Referring now to FIGS. 6 and 8, the exhaust conduit 214A has an inlet 220 at a first end 216 thereof connected to the manifold outlet 212. An outlet 222 of the exhaust conduit 214A is provided in a wall thereof. A pipe 224 is connected to the outlet 222 and has a diverging diameter to provide improved acoustic characteristics. Exhaust gases leaving the exhaust ports 210 travel first through the exhaust manifold, then to the exhaust conduit 214A by inlet 220, and then to the pipe 224 by outlet 222. Finally, as is common in the art of outboard engines, the exhaust gases are directed to the gear case 36, and exhaust in the body of water through or around the propeller 20 (FIG. 1). Note that exhaust conduit 214B has a similar construction, and therefore the numerical identifiers are the same and, for purposes of clarity, will not be repeated unless required. It is contemplated the exhaust conduits 214A, 214B could have many shapes and sizes. The exhaust conduit 214A can also have a different configuration than that of the exhaust conduit 214B.

Figure 7:
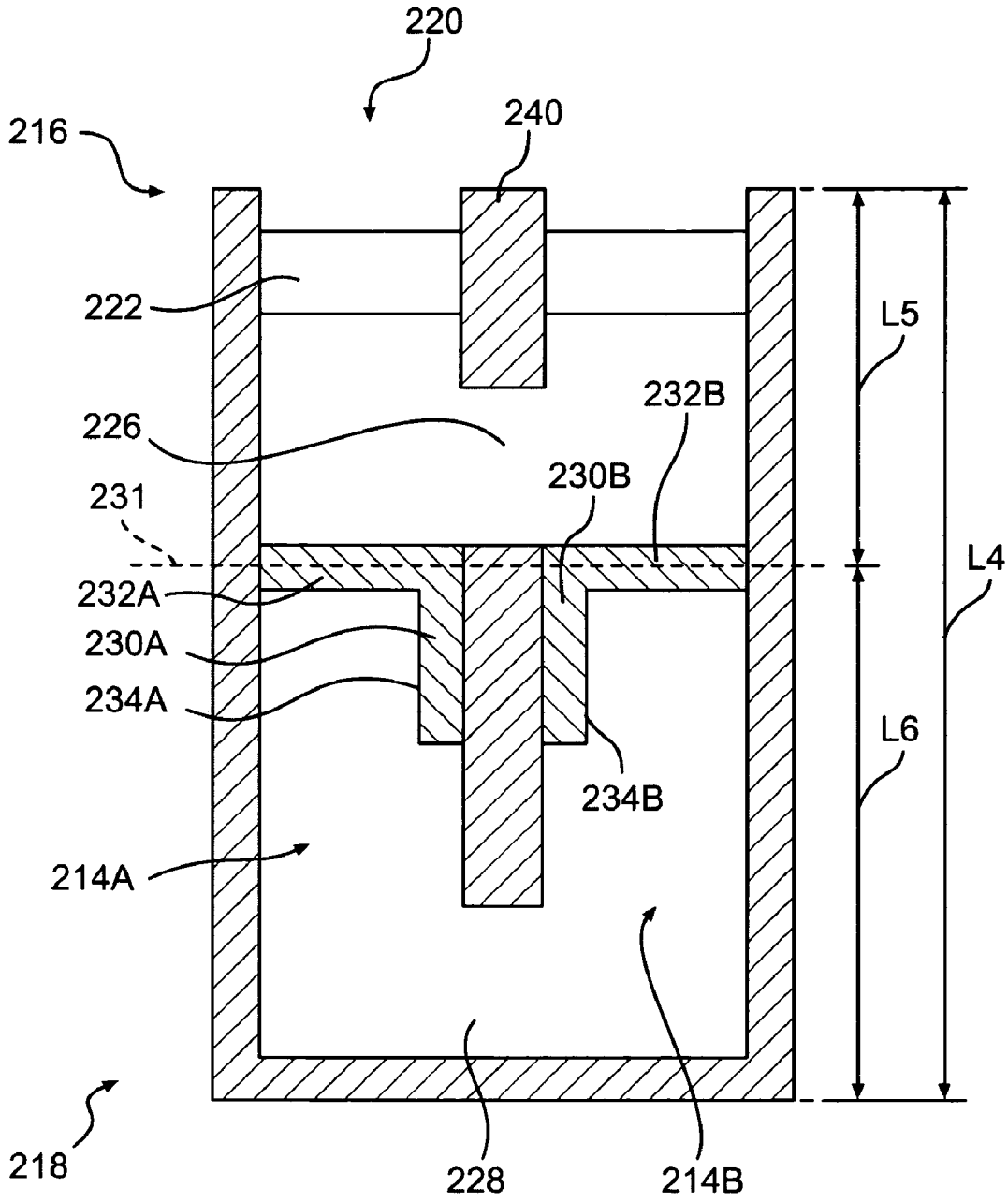
FIG. 7 is a schematic representation of a portion of a lateral cross-section of the outboard engine of FIG. 5 with the valve in the second position.
Figure 9:
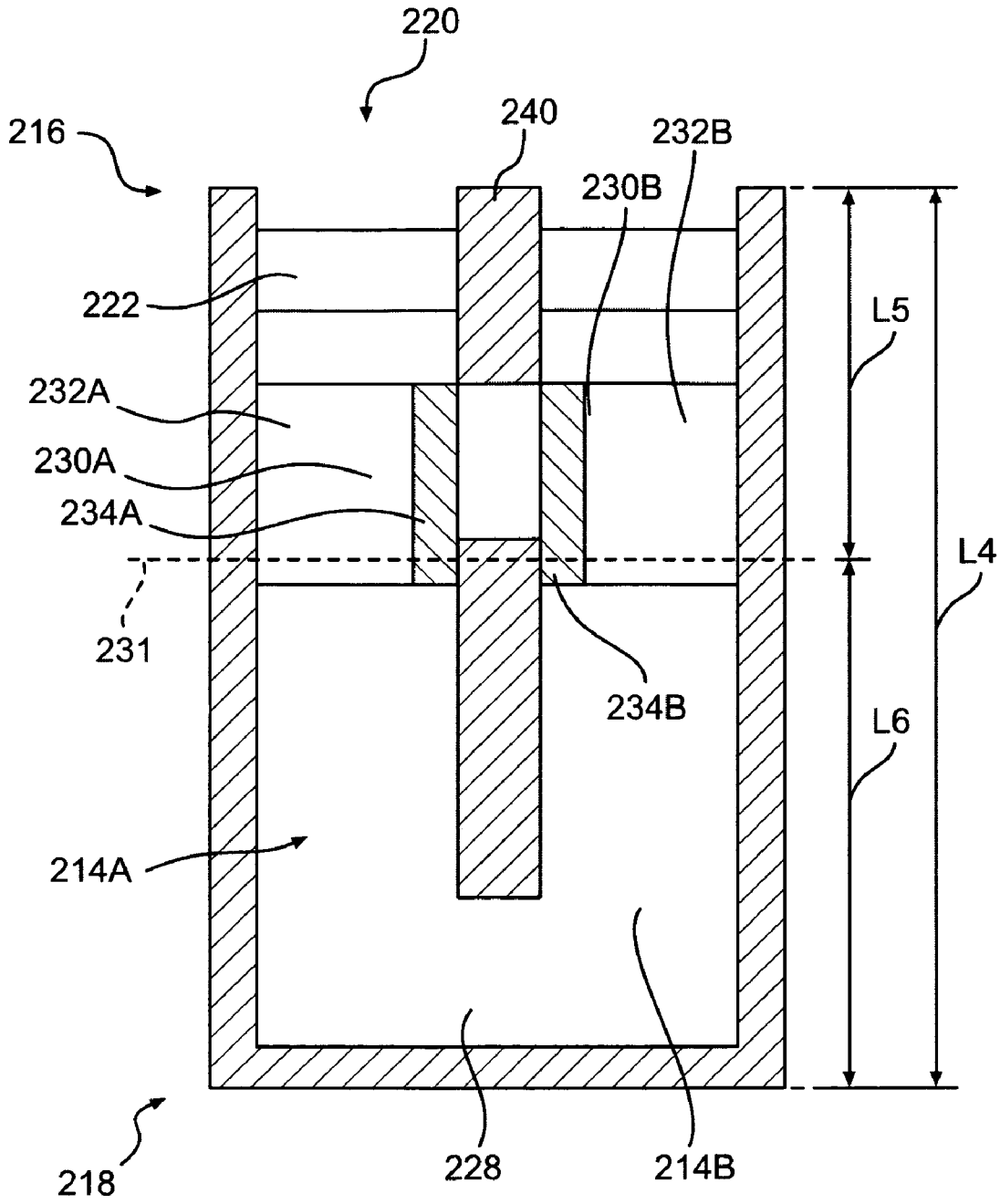
FIG. 9 is a schematic representation of a portion of a lateral cross-section of the outboard engine of FIG. 5 with the valve in the first position.

Referring now to FIGS. 7 and 9, in a preferred embodiment, a first passage 226, in the form of a first aperture, is located a common wall 240 of the exhaust conduits 214A, 214B to fluidly communicate the two together. Preferably, the first passage 226 is located completely below outlets 222 so as to prevent pressure to be lost therethrough. A second passage 228, in the form of a second aperture, is also located a common wall 242 of the exhaust conduits 214A, 214B to fluidly communicate the two together. The second passage is located at a second end 218 of the exhaust conduits 214A, 214B. It is contemplated that the common wall 242 could be only a smaller portion of the exhaust conduits 214A, 214B. It is also contemplated that the two exhaust conduits 214A, 214B could have no common wall 242 so as to be completely separate, and have passages 226, 228 in the form of conduits to communicate the two together.

The exhaust conduits 214A, 214B each have a valve 230A, 230B rotatable therein about pivot axis 231. The pivot axis 231 is located a distance L5 from the first end 216 of the exhaust conduits 214A, 214B. The actuator 208 (FIG. 5) is connected to a first linkage 236 (FIG. 6). When the actuator 208 rotates the first linkage 236, the first linkage pushes or pulls on a connecting rod 238 (FIG. 6) which in turn rotates a second linkage 240 (FIG. 6) about the pivot axis 231. The lengths of the first linkage 236, the connecting rod 238, and the second linkage 240 are selected so as to amplify the torque provided by the actuator 208. The valves 230A, 230B rotate simultaneously around pivot axis 231 with the second linkage 240 to which they are connected.

The valve 230A has a first side 232A and a second side 234A. The first side 232A and the second side 234A are connected in a generally L-shape. Similarly, the valve 230B has a first side 232B and a second side 234B. The first side 232B and the second side 234B are connected in a generally L-shape.

The actuator 208 moves the valves 230A, 230B between a first (FIGS. 8 and 9) and second position (FIGS. 6 and 7). When the valves 230A, 230B are in the second position, as shown in FIGS. 6 and 7, the passage 226 is opened and the first sides 232A, 232B of the valves 230A, 230B block the portions of the exhaust conduits 214A, 214B located between the pivot axis 231 and their second ends, and therefore the second passage 228. When the valves 230A, 230B are in this position, a pressure wave coming from the engine 14 and entering the exhaust conduit 214A travels first towards the valves 230A, 230B, then through passage 226, then towards then engine 14 through exhaust conduit 214B, and finally returns in the reverse direction.

When the valves 230A, 230B are in the first position, as shown in FIGS. 8 and 9, the passage 226 is closed by the second sides 234A, 234B of the valves 230A, 230B and the portions of the exhaust conduits 214A, 214B located between the pivot axis 231 and their second ends are no longer blocked by the first sides 232A, 232B of the valves 230A, 230B. When the valves 230A, 230B are in this position, a pressure wave coming from the engine 14 and entering the exhaust conduit 214A travels first past the valve 230A, then through passage 228, then past the valve 230B towards then engine 14 through exhaust conduit 214B, and finally returns in the reverse direction.

As in the first embodiment, the outlets 222 are locate in the section of the exhaust conduits 214A, 214B between the inlets 220 and the pivot axis 231. This way, the exhaust gases can leave the exhaust conduits through the outlets 222 to the atmosphere, or a body of water in marine applications, regardless of the position of the valves 230A, 230B.

In the first valve position, the pressure wave travels the full length L4 of the exhaust conduits 214A, 214B four time before returning to the exhaust ports. In the second valve position, the pressure wave travels only over a portion having a length L5 of the exhaust conduits 214A, 214B four times before returning to the exhaust ports. Since in the present embodiment L4 is always larger than L5, the valves 230A, 230B are rotated to the first position when the engine 14 operates below a predetermined engine speed, they are rotated to the second position when the engine 14 operates above the predetermined engine speed.

Figure 10:
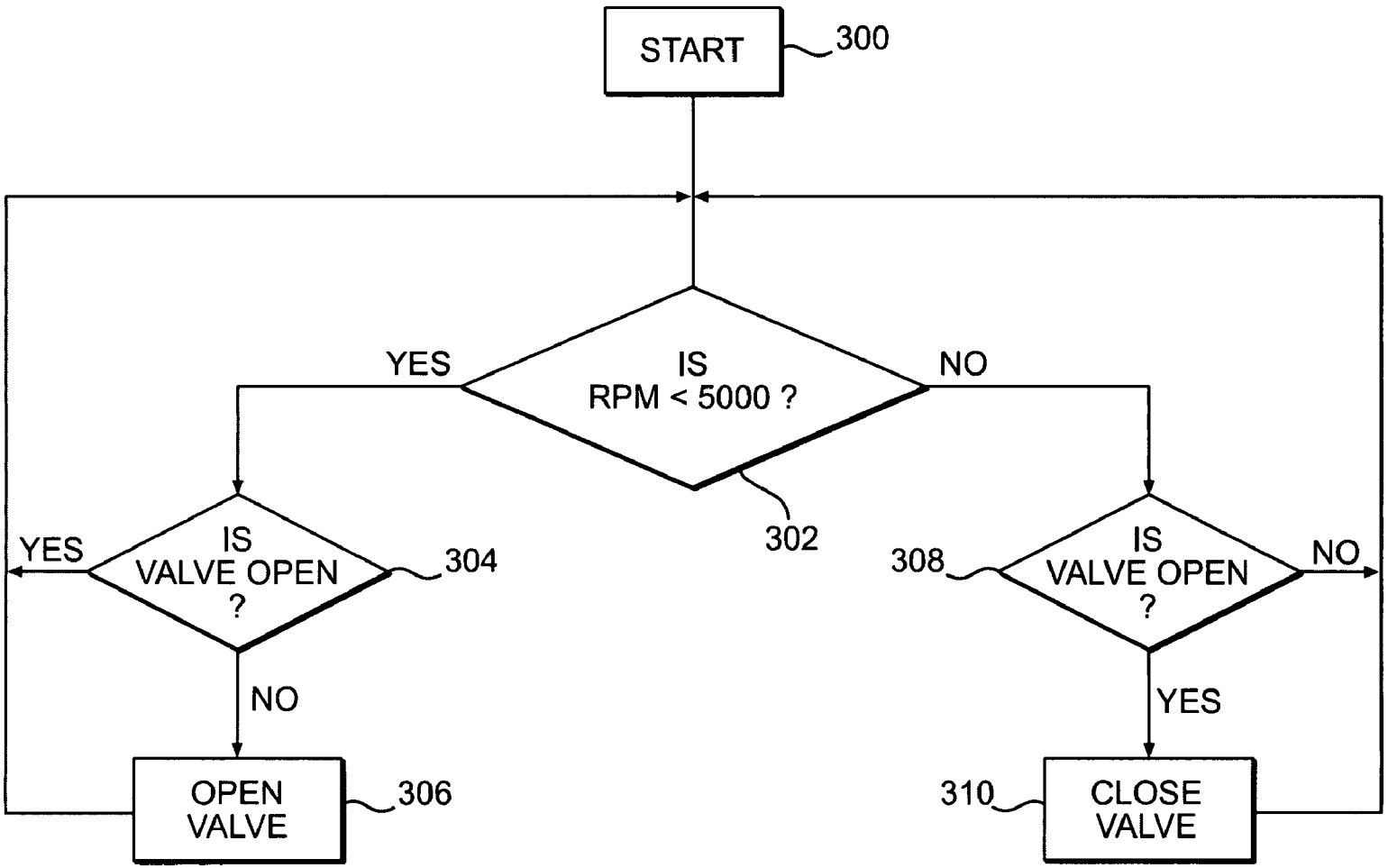
FIG. 10 is a diagram illustrating a method of operating an internal combustion engine with the present invention.

FIG. 10 shows a method for operating the valve(s) described in the previous embodiments. The steps of the method are carried out by an ECU of the engine 14. The method is initiated at step 300. The first step 302 consists in determining whether the actual engine speed is below a predetermined engine speed, in this case 5000 RPM. To do this, the ECU receives a signal from an engine speed sensor, located near the engine's flywheel for example, which is indicative of the actual engine speed. The ECU then compares this value to the predetermined value. If the actual engine speed is less than the predetermined speed, then the ECU moves to step 304. At step 304, the ECU determines if the valve is opened. If it is not, the ECU sends a signal to an actuator to open the valve in step 306. If the valve is already opened, then the ECU returns to step 302. If however, it is determined at step 302 that the actual engine speed is more than the predetermined speed, then the ECU moves to step 308. At step 308, the ECU determines if the valve is opened. If it is, the ECU sends a signal to an actuator to close the valve in step 310. If the valve is already closed, then the ECU returns to step 302.

Depending of the position of the passage between the exhaust conduits, it may be desirable to open the valve at speeds above the predetermined speed and close the valve at speeds below the predetermined speeds. In these cases, if it is determined at step 302 that the actual engine speed is more than the predetermined engine speed, then the ECU would move to step 304, and if it is less, it would move to step 308.

It is also contemplated that the engine load could be used in combination with the actual engine speed to determine whether the valve should be in the open or the closed position.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine comprising:

at least two cylinders;

each cylinder having a piston reciprocating therein and an exhaust port associated therewith for exhausting combustion gases therefrom, the exhaust port of each cylinder being opened and closed by reciprocating motion of that cylinder's piston;

exhaust conduits, one conduit associated with each of the cylinders, each conduit having an inlet, an outlet and an end, the outlet being disposed between the inlet and the end, the inlet of each conduit being in fluid communication with the exhaust port of the cylinder with which that conduit is associated;

an aperture fluidly communicating two of the exhaust conduits together, the two exhaust conduits fluidly communicating together having a common wall, the aperture being disposed in the common wall; and a valve having a first position closing the aperture and allowing pressure waves from each of the cylinders communicating via the aperture to travel from the inlet of the conduit associated with that cylinder, through that conduit to at least a point in that conduit further from the inlet than the aperture, and the valve having a second position opening the aperture allowing pressure waves from that cylinder to travel from the inlet of that conduit through the aperture and into the conduit associated with the other cylinder;

the engine operating on a two-stroke principle.

2. The engine of claim 1, wherein when the valve is in the second position, the valve precludes pressure waves from that cylinder from traveling to the end of that conduit.

3. The engine of claim 1, wherein the point in that conduit further from the inlet than the aperture is the end of that conduit.

4. The engine of claim 3, wherein when the valve is in the first position, a pressure wave from one of the cylinders travels from the inlet of the exhaust conduit with which it is associated to the end of that conduit and is reflected back to the inlet of that conduit, and when the valve is in the second position, the pressure wave from that cylinder travels from the inlet of that conduit, through the aperture, to the inlet of the other conduit, back through the aperture, and back to the inlet of that conduit.

5. The engine of claim 1, wherein the valve is a butterfly valve.

6. The engine of claim 1, further comprising:

an actuator for moving the valve between the first and the second position;

a sensor sending a signal indicative of actual engine speed; and an electronic control unit receiving the signal and controlling the actuator by comparing the actual engine speed to a predetermined engine speed.

7. The engine of claim 6, wherein the actuator moves the valve to the first position when the actual engine speed is higher than the predetermined engine speed, and to the second position when the actual engine speed is lower than the predetermined engine speed.

8. The engine of claim 7, wherein a combined distance from the inlet of that conduit to the aperture, and from the aperture to the inlet of the conduit associated with the other cylinder is greater than a distance from the inlet of that conduit to its corresponding end.

9. The engine of claim 5, wherein the actuator moves the valve to the first position when the actual engine speed is lower than the predetermined engine speed, and to the second position when the actual engine speed is higher than the predetermined engine speed.

10. The engine of claim 9, wherein a combined distance from the inlet of that conduit to the aperture, and from the aperture to the inlet of the conduit associated with the other cylinder is less than a distance from the inlet of that conduit to its corresponding end.

11. The engine of claim 9, the engine further comprising a passage fluidly communicating the two exhaust conduits together; and the passage being disposed between the aperture and the end of each exhaust conduit.

12. The engine of claim 11, wherein a combined distance from the inlet of that conduit to the aperture, and from the aperture to the inlet of the conduit associated with the other cylinder is less than a combined distance from inlet of that conduit to the passage, and from the passage to the inlet of the conduit associated with the other cylinder.

13. The engine of claim 1, wherein the valve is two valves, each valve being disposed in a different exhaust conduit.

14. The engine of claim 13, wherein each valve has two sides forming a L-shape, one of the sides closing the aperture when the valve is in the first position, the other one of the sides prohibiting exhaust gases to flow from the inlet to the end of the exhaust conduit in which it is disposed when the valve is in the second position.

15. The engine of claim 1, wherein each exhaust conduit is a tuned pipe having a diverging section near the inlet, a converging section at the end, and a generally constant diameter section between the diverging section and the converging section.

16. The engine of claim 1, wherein each outlet fluidly communicates with a pipe having a diverging diameter.

17. The engine of claim 1, wherein the at least two cylinders is at least four cylinders, and each inlet fluidly communicates with a different pair of exhaust ports.

18. An outboard engine comprising:

a cowling;

an engine operating on a two-stroke principle, the engine being enclosed by the cowling;

the engine having at least two cylinders;

each cylinder having a piston reciprocating therein and an exhaust port associated therewith for exhausting combustion gases therefrom, the exhaust port of each cylinder being opened and closed by reciprocating motion of that cylinder's piston;

a vertically oriented driveshaft coupled to the engine;

a transmission coupled to the driveshaft;

a horizontally oriented propeller shaft coupled to the transmission;

a propeller coupled to the propeller shaft;

exhaust conduits, one conduit associated with each of the cylinders, each conduit having an inlet, an outlet and an end, the outlet being disposed between the inlet and the end, the inlet of each conduit being in fluid communication with the exhaust port of the cylinder with which that conduit is associated;

a passage fluidly communicating two of the exhaust conduits together; and a valve having a first position closing the passage and allowing pressure waves from each of the cylinders communicating via the passage to travel from the inlet of the conduit associated with that cylinder, through that conduit to at least a point in that conduit further from the inlet than the passage, and the valve having a second position opening the passage allowing pressure waves from that cylinder to travel from the inlet of that conduit through the passage and into the conduit associated with the other cylinder.

19. A method of operating an internal combustion engine having exhaust ports comprising the steps of:

providing two exhaust conduits each communicating with a different exhaust port of the engine;

providing a valve for opening and closing a passage located between the two exhaust conduits so as to fluidly communicate the exhaust conduits together;

sensing an actual engine speed; and opening the valve when the actual engine speed is within a first range of speeds and closing the valve when the actual engine speed is within a second range of speeds.

20. An internal combustion engine comprising:

at least two cylinders;

each cylinder having a piston reciprocating therein and an exhaust port associated therewith for exhausting combustion gases therefrom, the exhaust port of each cylinder being opened and closed by reciprocating motion of that cylinder's piston;

exhaust conduits, one conduit associated with each of the cylinders, each conduit having an inlet, an outlet and an end, the outlet being disposed between the inlet and the end, the inlet of each conduit being in fluid communication with the exhaust port of the cylinder with which that conduit is associated;

a passage fluidly communicating two of the exhaust conduits together;

a valve having a first position closing the passage and allowing pressure waves from each of the cylinders communicating via the passage to travel from the inlet of the conduit associated with that cylinder, through that conduit to at least a point in that conduit further from the inlet than the passage, and the valve having a second position opening the passage allowing pressure waves from that cylinder to travel from the inlet of that conduit through the passage and into the conduit associated with the other cylinder;

an actuator for moving the valve between the first and the second position;

a sensor sending a signal indicative of actual engine speed; and an electronic control unit receiving the signal and controlling the actuator by comparing the actual engine speed to a predetermined engine speed;

the engine operating on a two-stroke principle.

21. The engine of claim 20, wherein when the valve is in the second position, the valve precludes pressure waves from that cylinder from traveling to the end of that conduit.

22. The engine of claim 20, wherein the point in that conduit further from the inlet than the passage is the end of that conduit.

23. The engine of claim 22, wherein when the valve is in the first position, a pressure wave from one of the cylinders travels from the inlet of the exhaust conduit with which it is associated to the end of that conduit and is reflected back to the inlet of that conduit, and when the valve is in the second position, the pressure wave from that cylinder travels from the inlet of that conduit, through the passage, to the inlet of the other conduit, back through the passage, and back to the inlet of that conduit.

24. The engine of claim 20, wherein the two exhaust conduits fluidly communicating together have a common wall, and the passage is an aperture in the common wall.

25. The engine of claim 24, wherein the valve is a butterfly valve.

26. The engine of claim 20, wherein the actuator moves the valve to the first position when the actual engine speed is higher than the predetermined engine speed, and to the second position when the actual engine speed is lower than the predetermined engine speed.

27. The engine of claim 26, wherein a combined distance from the inlet of that conduit to the passage, and from the passage to the inlet of the conduit associated with the other cylinder is greater than a distance from the inlet of that conduit to its corresponding end.

28. The engine of claim 21, wherein the actuator moves the valve to the first position when the actual engine speed is lower than the predetermined engine speed, and to the second position when the actual engine speed is higher than the predetermined engine speed.

29. The engine of claim 28, wherein a combined distance from the inlet of that conduit to the passage, and from the passage to the inlet of the conduit associated with the other cylinder is less than a distance from the inlet of that conduit to its corresponding end.

30. The engine of claim 28, wherein the passage is a first passage;

the engine further comprising a second passage fluidly communicating the two exhaust conduits together; and the second passage being disposed between the first passage and the end of each exhaust conduit.

31. The engine of claim 30, wherein a combined distance from the inlet of that conduit to the first passage, and from the first passage to the inlet of the conduit associated with the other cylinder is less than a combined distance from inlet of that conduit to the second passage, and from the second passage to the inlet of the conduit associated with the other cylinder.

32. The engine of claim 20, wherein the valve is two valves, each valve being disposed in a different exhaust conduit.

33. The engine of claim 32, wherein each valve has two sides forming a L-shape, one of the sides closing the passage when the valve is in the first position, the other one of the sides prohibiting exhaust gases to flow from the inlet to the end of the exhaust conduit in which it is disposed when the valve is in the second position.

34. The engine of claim 20, wherein each exhaust conduit is a tuned pipe having a diverging section near the inlet, a converging section at the end, and a generally constant diameter section between the diverging section and the converging section.

35. The engine of claim 20, wherein each outlet fluidly communicates with a pipe having a diverging diameter.

36. The engine of claim 20, wherein the at least two cylinders is at least four cylinders, and each inlet fluidly communicates with a different pair of exhaust ports.

* * * * *